US010531727B2

(12) United States Patent
Sze

(10) Patent No.: US 10,531,727 B2
(45) Date of Patent: Jan. 14, 2020

(54) METHODS OF MANUFACTURING A HAIR BRUSH AND HAIR BRUSHES MADE THEREFROM

(71) Applicant: Tung Hing Plastic Manufactory Ltd., Kowloon (CN)

(72) Inventor: Ka Chuen Sze, Kowloon (CN)

(73) Assignee: Tung Hing Plastic Manufactory Ltd., Kowloon (CN)

( * ) Notice: Subject to any disclaimer, the term of this patent is extended or adjusted under 35 U.S.C. 154(b) by 184 days.

(21) Appl. No.: 15/724,501

(22) Filed: Oct. 4, 2017

(65) Prior Publication Data

US 2018/0103748 A1 Apr. 19, 2018

(30) Foreign Application Priority Data

Oct. 19, 2016 (GB) ..... 1617681.0

(51) Int. Cl.

| | |
|---|---|
| ***A46B 7/06*** | (2006.01) |
| ***A46B 3/20*** | (2006.01) |
| ***A46B 9/02*** | (2006.01) |
| ***A46D 3/00*** | (2006.01) |

(52) U.S. Cl.

CPC ..... *A46B 7/06* (2013.01); *A46B 3/20* (2013.01); *A46B 9/023* (2013.01); *A46B 9/026* (2013.01); *A46D 3/005* (2013.01); *A46B 2200/104* (2013.01)

(58) Field of Classification Search

CPC .. A46B 7/06; A46B 3/20; A46B 9/023; A46B 9/026; A46D 3/005

See application file for complete search history.

(56) References Cited

U.S. PATENT DOCUMENTS

| | | | | |
|---|---|---|---|---|
| 2012/0167323 | A1* | 7/2012 | Williams | A46B 9/06 15/160 |
| 2015/0135455 | A1* | 5/2015 | Reusche | A46B 9/06 15/160 |

FOREIGN PATENT DOCUMENTS

| | | |
|---|---|---|
| EP | 2160955 | 10/2010 |
| FR | 2307493 | 11/1976 |
| GB | 2534667 | 8/2016 |

* cited by examiner

*Primary Examiner* — Shay Karls

(74) *Attorney, Agent, or Firm* — Heslin Rothenberg Farley & Mesiti P.C.; Melvin S. Li; Kristian E. Ziegler

(57) ABSTRACT

There is provided a method of manufacture of a hair brush. The method has the steps, in the sequence of, i) forming a base layer in the form of a mesh by way of a first molding step, the base layer defining an upper surface and a lower surface opposite the upper surface, made of a first material selected from a group consisting of polypropylene (PP), nylon, polyoxymethylene (POM) and thermoplastic elastomer (TPE), and including a plurality of recesses with apertures at the upper surface, ii) forming a substrate layer for supporting bristles of the hair brush by a second molding step of overmoulding a finishing layer over the base layer, the finishing layer made of a second material; iii) installing the bristles to the substrate layer at the recesses through the apertures; and iv) assembling the substrate layer installed with the bristles to a casing of the hair brush.

24 Claims, 5 Drawing Sheets

METHODS OF MANUFACTURING A HAIR BRUSH AND HAIR BRUSHES MADE THEREFROM

CROSS REFERENCE TO RELATED APPLICATION

This application claims priority to earlier filed GB Patent Application No. 1617681.0, filed Oct. 19, 2016, the contents of which, in its entirety, is hereby expressly incorporated herein.

FIELD OF THE INVENTION

The present invention is concerned with improved methods of manufacture of a hair brush, and in particular a cushion hair brush, and hair brushes or cushion hair brushes made therefrom.

BACKGROUND OF THE INVENTION

There is a variety of hair styling tools in the market. One particular type of such tools is known as cushion brush in which during use, bristles of the brush sink or rise together with a supporting layer in response to pressure applied thereon. However, conventional cushion brushes suffer from different problems. For example, under conditions of repeated reciprocating movement of the bristles and the supporting layer and/or fluctuating temperature they tend to be rather non-durable. Issues of comfort, ease and cost of manufacture, etc. are other problems that are to be addressed.

The present invention seeks to addresses these issues, or at least to provide a useful alternative to the public.

SUMMARY OF THE INVENTION

According to a first aspect of the present invention, there is provided a method of manufacture of a hair brush, comprising steps in the sequence of: forming a base layer in the form of a mesh by way of a first molding step, the base layer defining an upper surface and a lower surface opposite to the upper surface, made of a first material selected from the group consisting of polypropylene (PP), nylon, polyoxymethylene (POM) and thermoplastic elastomer (TPE), and including a plurality of recesses with apertures at the upper surface; forming a substrate layer for supporting bristles of the hair brush by a second molding step of overmoulding a finishing layer over the base layer, the finishing layer made of a second material; and installing the bristles to the substrate layer at the recesses through the apertures; and assembling the substrate layer installed with the bristles to a casing of the hair brush.

Preferably, the base layer may have a Flexural Modulus from substantially 900-1300 MPa.

Suitably, the recesses may be in the form of cups sized and shaped to receive end portion of the bristles shot or otherwise installed into the recesses.

In an embodiment, the second material may be selected from the group consisting of silicone, rubber and thermoplastic elastomer (TPE).

The finishing layer may have a Flexural Modulus from substantially 51-69 MPa. In an embodiment, the finishing layer may have a Flexural Modulus of substantially 60 MPa.

The substrate layer may have a Flexural Modulus from substantially 68-92 MPa. In an embodiment, the substrate layer may have a Flexural Modulus of substantially 80 MPa.

In one embodiment, after the second moulding step, at least part of the apertures may remain open.

In another embodiment, after the second moulding step, the lower surface may not be overmoulded with the second material.

The bristles may be secured in the recesses of the base layer by using pins or staples.

Advantageously, the method may be free of using glue in securing the bristles to the base layer.

According to a second aspect of the present invention, there is provided a method of manufacture of a hair brush, comprising steps in the sequence of: forming a base layer in the form of a mesh by way of a first molding step, the base layer defining an upper surface and a lower surface opposite the upper surface, and made of a first material with a Flexural Modulus from substantially 900-1300 MPa; forming a substrate layer for supporting bristles of the hair brush by a second molding step of overmoulding a finishing layer over the base layer, the finishing layer made of a second material; and installing the bristles to the substrate layer at the recesses through the apertures; and assembling the substrate layer installed with the bristles to a casing of the hair brush.

According to a third aspect of the present invention, there is provided a cushion hair brush comprising; a base layer in the form of a mesh formed by first injection molding step, said base layer defining an upper surface and a lower surface opposite the upper surface, made of a first material with a Flexural Modulus from substantially 900-1300 MPa, and including a plurality of recesses with apertures at the upper surface; a substrate layer for supporting bristles of said hair brush, said substrate layer including a finishing layer overmoulded over said base layer, said finishing layer made of a second material with a Flexural Modulus from substantially 51-69 MPa; and bristles installed to said substrate layer at the recesses via the apertures; and a housing fitted with said bristle-installed substrate layer; wherein said substrate layer, at default, assumes a dome shape defining a outwardly facing and concave surface, and is adapted to respond to pressure applied to the bristles during use by inwardly flexing towards the housing thus producing a cushioning effect.

Preferably, the recesses may be \in the form of cups sized and shaped to receive end portion of said bristles shot or otherwise installed into the recesses.

The first material may be selected from the group consisting of polypropylene (PP), nylon, polyoxymethylene (POM) and thermoplastic elastomer (TPE). The second material may be selected from the group consisting of silicone, rubber and thermoplastic elastomer (TPE).

In an embodiment, the finishing layer may have a Flexural Modulus from substantially 60 MPa.

The substrate layer may have a Flexural Modulus from substantially 68-92 MPa, or in a specific embodiment, it is substantially 80 MPa.

Preferably, at least part of the apertures of the base layer overmoulded with the finishing layer may remain open. The lower surface of the base layer may not be overmoulded with the second material.

The hair brush may comprise pins or staples for securing the bristles in the recesses of the base layer. The hair brush may be free of glue for securing said bristles to said base layer.

BRIEF DESCRIPTION OF THE DRAWINGS

Some embodiments of the present invention will now be explained, with reference to the accompanied drawings, in which.

DETAILED DESCRIPTION OF PREFERRED EMBODIMENTS OF THE INVENTION

Figure 1:
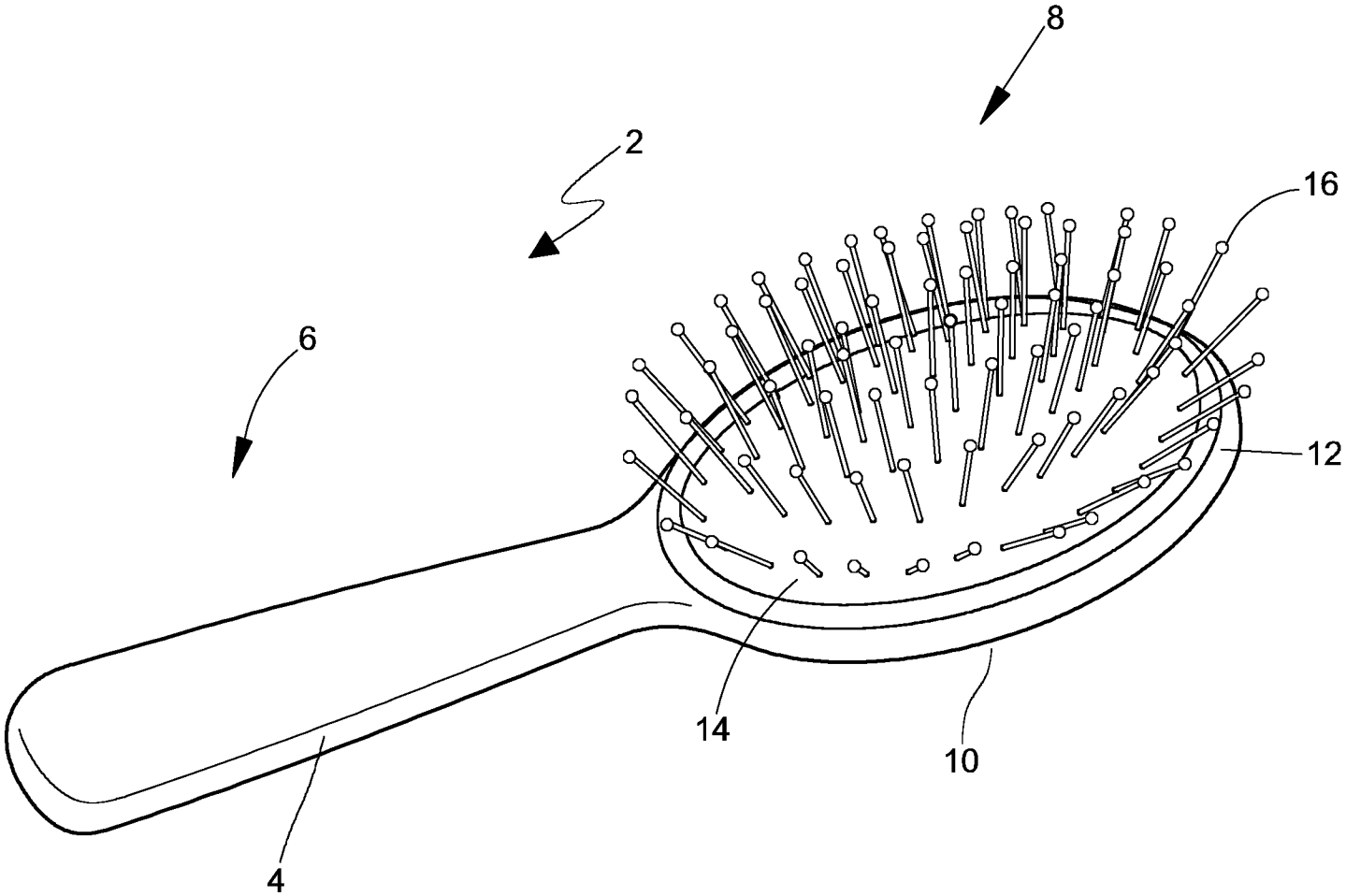
FIG. 1 is a perspective view showing an embodiment of a cushion hair brush according to an aspect of the present invention, the brush made by an embodiment of a method according to another aspect of the present invention.

One aspect of the present invention is concerned with a method of manufacture of a cushion hair brush. FIG. 1 is a perspective view showing the general profile of an example of a hair brush, designated 2, made from an embodiment of the manufacture method according to the present invention.

The brush 2 has a handle portion 4 at a rear end 6 and a hair styling portion 8 at the opposite (front) end 10. In this embodiment, the styling portion 8 is generally oval in shape and includes a casing 12 at a lower part thereof and a cushioning part 14 fitted within the boundary of the casing 12. The cushioning part 14 is provided with a plurality of bristles 16 upwardly extending away from the casing 12.

Figure 2:
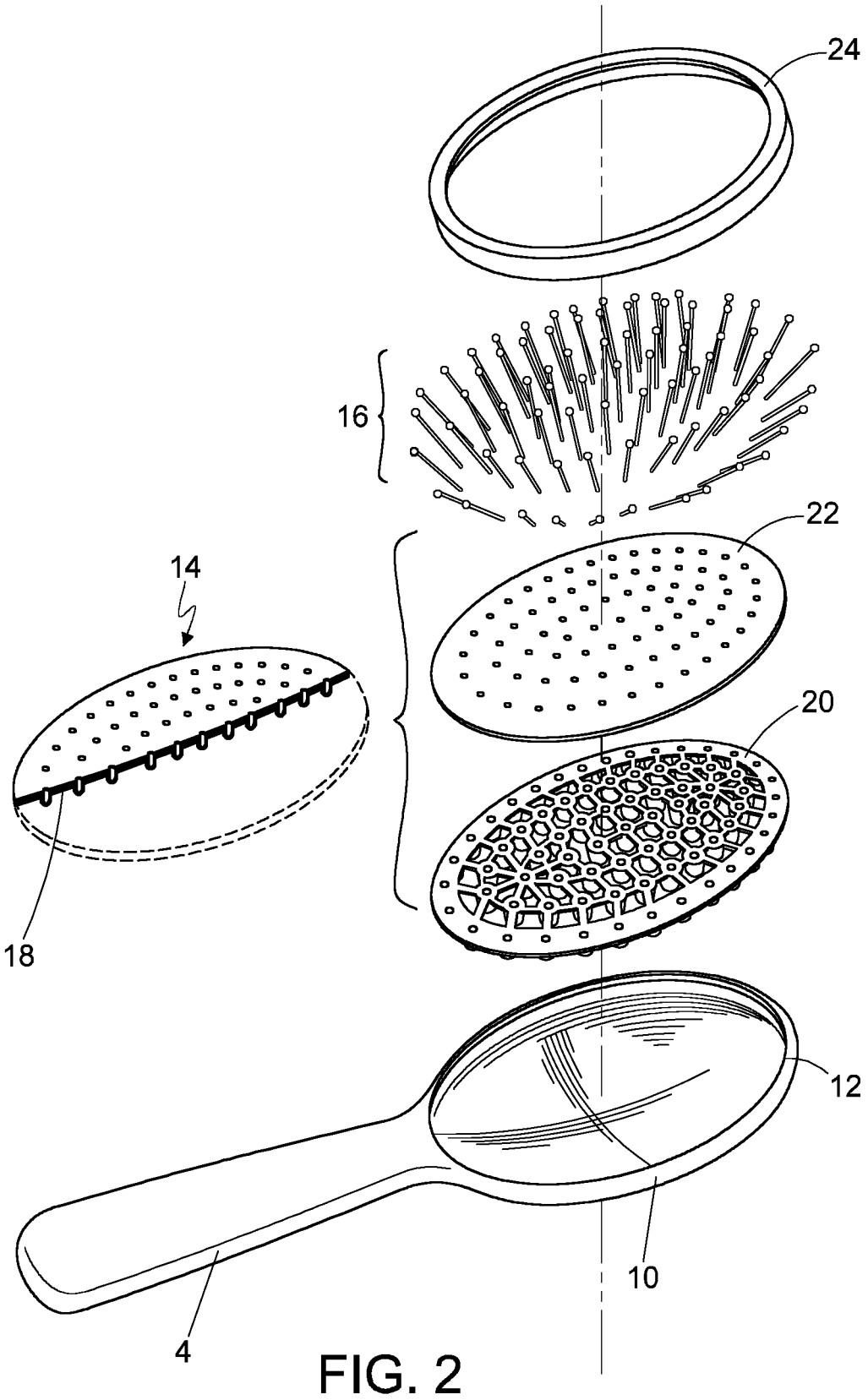
FIG. 2 is an exploded view showing major components forming the brush of FIG. 1.

FIG. 2 is an exploded view showing different major components of the hair brush 2. Particularly, the brush 2 has a combination handle and casing 4, 12, a substrate layer 18 made of a base layer 20 and a finishing layer 22, the bristles 16 extending from the substrate layer 18, and an oval ring 24 fitted around the substrate layer 18 for assisting the securing of the substrate layer 18 to the casing 12.

Figure 3A:
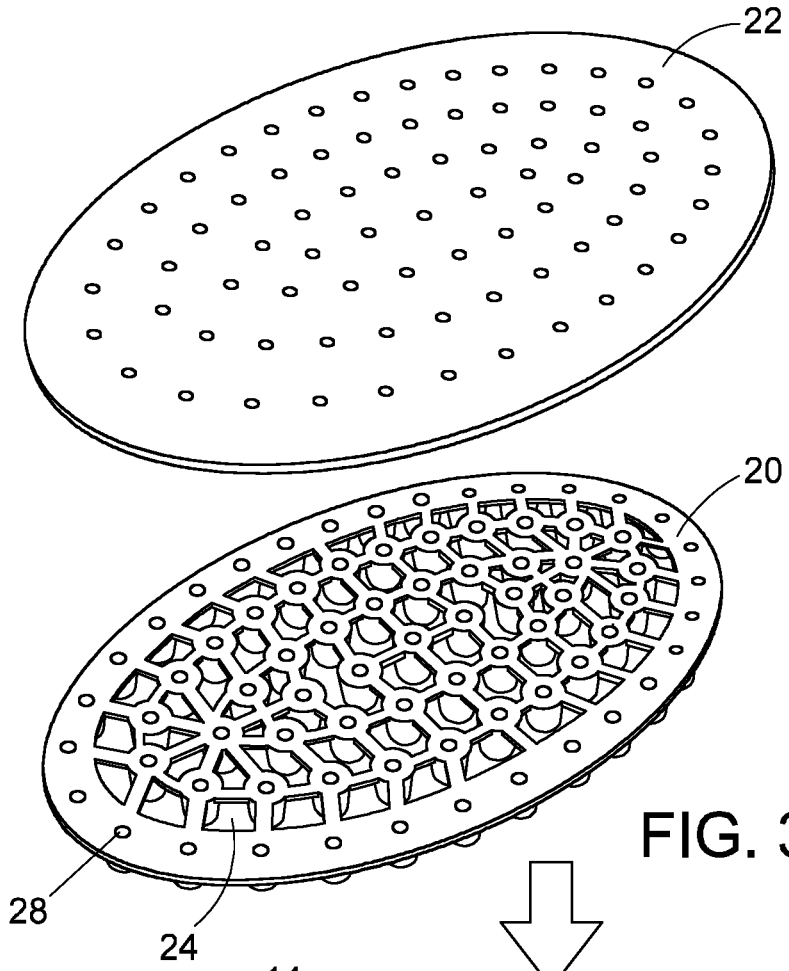
FIGS. 3A and 3B are two schematic views showing some of the major components of FIG. 2.
Figure 3B:
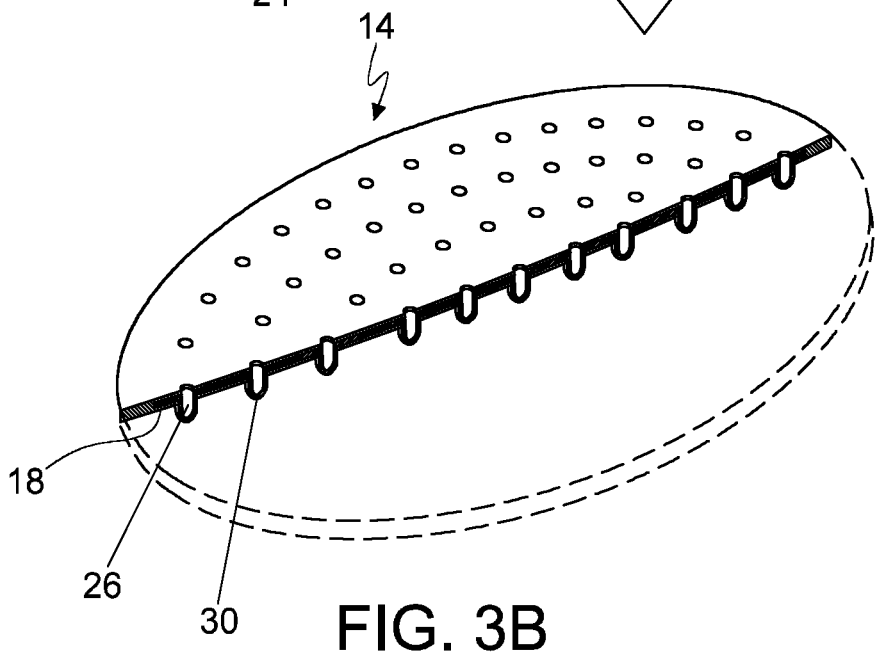
Figure 4A:
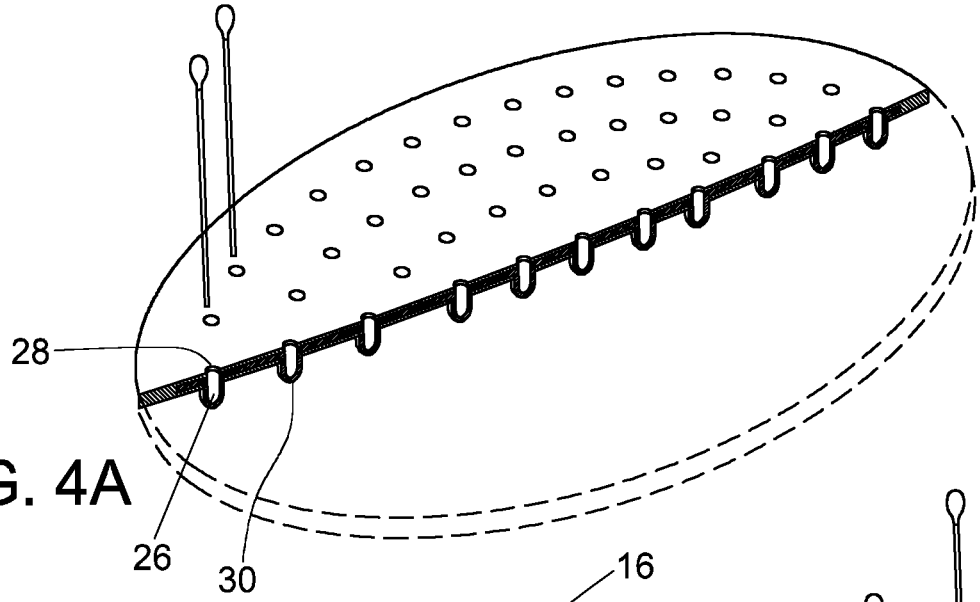
FIGS. 4A, 4B and 4C are schematic views showing connection of bristles to a supporting layer of the brush of FIG. 1.
Figure 4B:
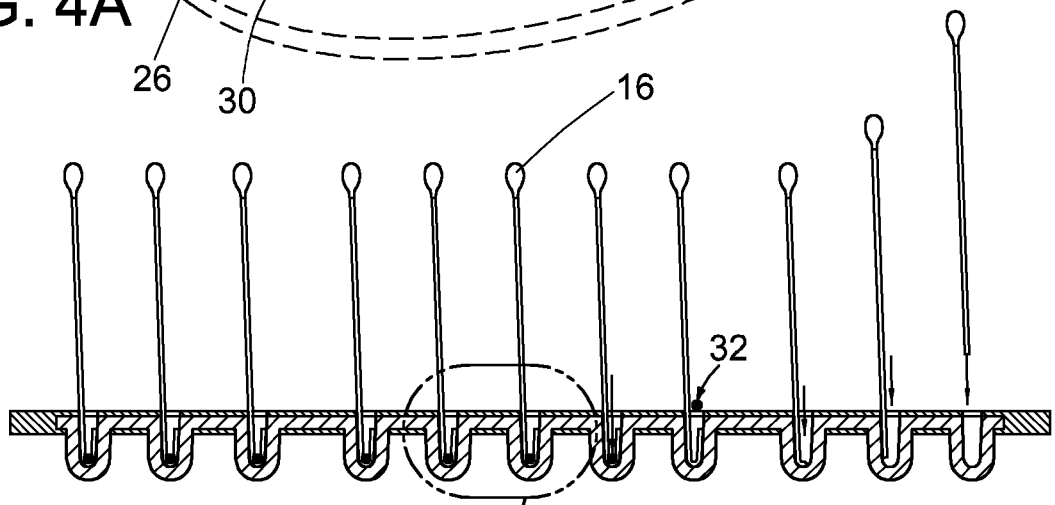
Figure 4C:
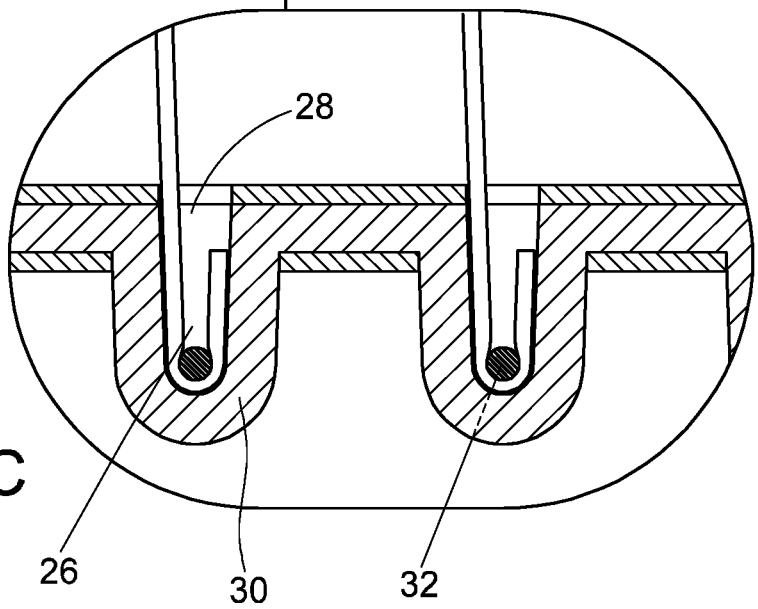
Figure 5A:
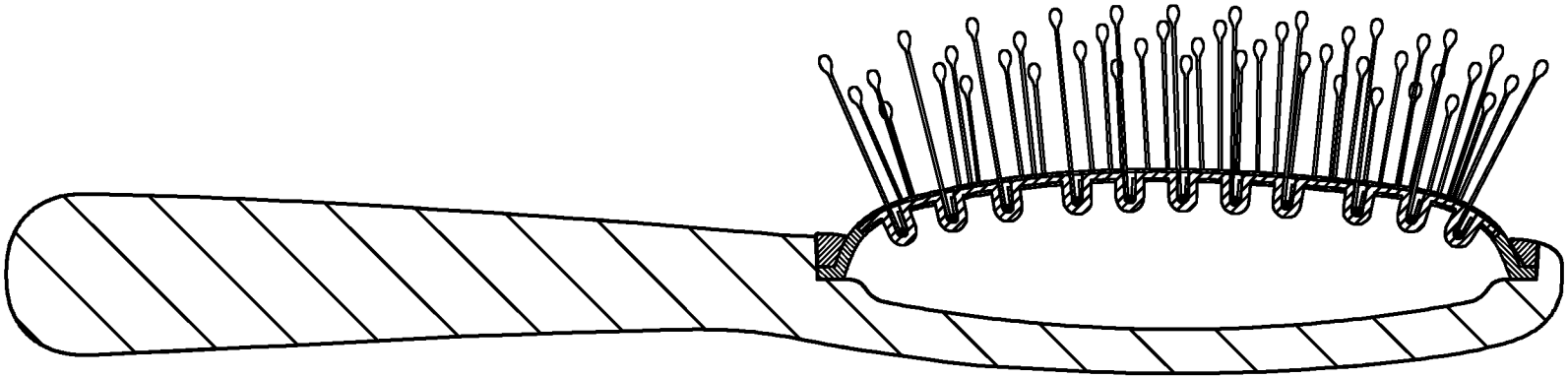
FIGS. 5A and 5B are schematic views showing operation of the brush of FIG. 1 during use.
Figure 5B:
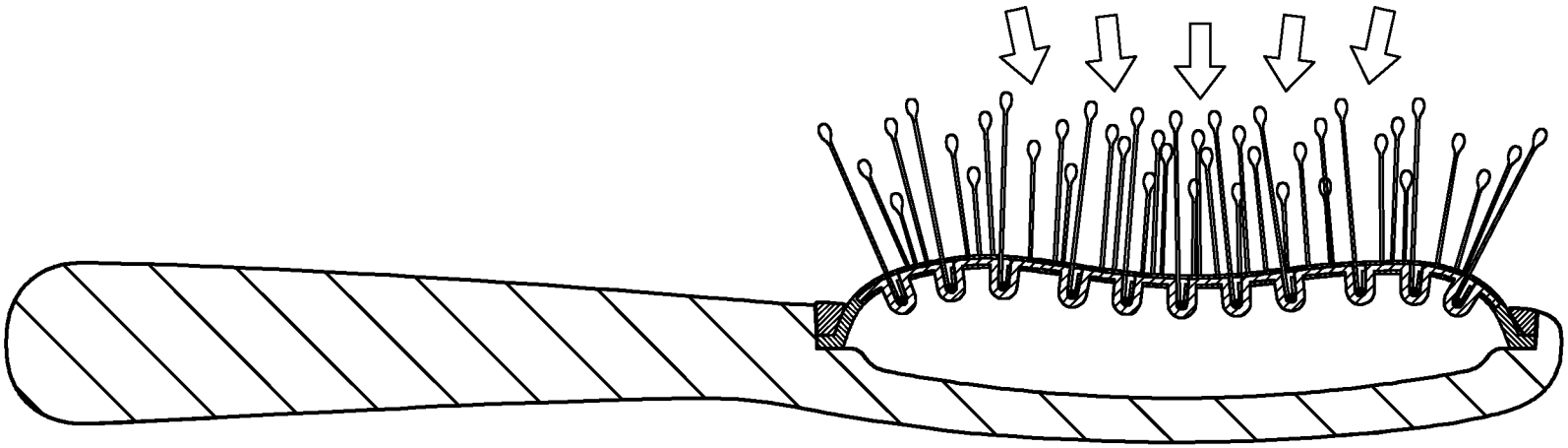

FIGS. 3A and 3B illustrate other exploded views showing some of the different major components of in FIG. 2. In particular, they demonstrate the construction of the substrate layer 18 from the base layer 20 and the finishing (or covering) layer 22. During the course of manufacture, the substrate layer 18 is formed via a first moulding step (or preferably injection moulding step). Then the finishing layer 22 is moulded (or injection moulded) over the base layer 20, thus forming an integral substrate layer 18 as shown in FIG. 3B.

The base layer 20 takes the form of a mesh resembling a net with through openings 24, the mesh defining an upper surface and a lower surface. The mesh is provided with recesses 26 defined by a plurality of cup members 30 with upwardly facing apertures 28. FIGS. 3B and 4A-4C show that the cup members 30 have a depth which is relatively longer than the width of apertures. In a preferred embodiment, the minimum height or depth of the cup members is at least 5 mm. In the embodiment shown in FIG. 3A, although the base layer 20 has an oval shape the cup members 30 are arranged roughly concentrically and spaced apart evenly on the oval shaped base layer. The cup members 30 are connected by ridges which form the mesh.

The base layer 20 is made of a first material selected from the group consisting of polypropylene (PP), nylon, polyoxymethylene (POM) and thermoplastic elastic (TPE). In this embodiment, the Flexural Modulus of the base layer is substantially 900 Mpa. However, studies leading to the present invention show that the Flexural Modulus of the base layer may range from substantially 900-1300 MPa and work effectively in the context of this present invention.

The substrate layer is made by forming a finishing layer 22 above the base layer 20. In one embodiment, preferably, it is achieved by over-molding the finishing layer 22 to the base layer 20. In this embodiment, despite the over-moulding the apertures are not covered and remain exposed after the overmoulding. Further, lower surface of the base layer 20 remains exposed after the overmoulding. In other words, the overmoulding applies primarily to the upper layer only. In an alternative embodiment of overmoulding, the substrate layer 18 may be formed by pre-forming a standalone finishing layer 22, and then joining the finishing layer to the base layer 20 by heating sealing such that the finishing layer 22 and the base layer 20 become connected and integrally formed. However, the former approach is advantageous in that the completed substrate layer 18 together with the bristles 16 extended therefrom moves more in sync and is more durable.

Regardless of how the finishing layer is formed, it is preferably made of a second material that is softer than the first material, such that it can provide a better comfort touch to hair and scalp of a user. Preferably, the second material is thermoplastic elastomer (TPE) and/or has a Flexural Modulus from substantially 51-69 MPa. In the embodiment of FIG. 3A, it has a Flexural Modulus of substantially 60 MPa.

The integral substrate layer formed is configured to have a Flexural Modulus from substantially 68-92 MPa. In the embodiment of FIG. 3A, it has a Flexural Modulus of substantially 60 MPa.

After the substrate layer is formed, it is ready to receive the bristles 16 to the substrate layer 18. In this embodiment, it is achieved by installing the bristles 16 in the recesses 26 defined by the cup members 30 such that each cup member 30 receives one bristle 16. Each bristle 16 is secured in the respective recess 26 by a locking pin 30 in the form of a staple. A skilled person in the art would realize the approach to install such pins in the substrate layer.

The features explained are advantageous in a number of ways. First, the first material is relatively stiff and provide suitable rigidity to the eventually formed substrate layer 18. At the same time, the more rigid base layer 20 performs better in holding the bristles 16 and thus entails a more durable brush. Second, the use of a dual-material substrate layer 18 provides a different, and more contact comfortable, layer, to engage with hair and scalp of a user. This would not be possible if the entire substrate layer 18 were made of one material. Third, the substrate layer 18 made from the base layer 20 and the finishing layer 22 is formed without making use of any adhesive or glue. The lack of using adhesive or glue is significant because during hair styling hot air blowing drying is often used at the same time. Bonding relying on adhesives or glues often would weaken under heated conditions. Further, bonding relying on adhesives or glues also would weaken under repeated movement. One aspect of the present invention allows doing away the use of adhesives or glues, thus improving durability of the brush. Studies have shown that the desired behaviors of a cushion brush made with the afore-explained technical features are contributed by the combination of choice of materials or choice of flexural strength characteristics set forth above. By the desired behavior, it means the improved cushioning behavior, contact comfort behavior, durability behavior, etc.

As explained above, the afore-described embodiment of manufacture method includes: forming a base layer in the form of a mesh by way of a first molding step, the base layer defining an upper surface and a lower surface opposite the upper surface, made of a first material selected from the group consisting of polypropylene (PP), nylon, polyoxymethylene (POM) and thermoplastic elastomer (TPE), and including a plurality of recesses with apertures at the upper surface; forming a substrate layer for supporting bristles of the hair brush by a second molding step of overmoulding a finishing layer over the base layer, the finishing layer made of a second material; installing the bristles to the substrate layer at the recesses through the apertures; and assembling the substrate layer installed with the bristles to a casing of the hair brush. The features concerning the afore-described embodiment of manufacture method are also advantageous. For example, unlike including a step of using adhesives or glues which is relatively difficult to control in a manufacturing sense the do-away of the gluing step can provide reliability and efficiency during efficient. Further, the use of a dual-material substrate layer can allow the use of less material in making the substrate layer, thus translation to cost efficiency. It is to be noted that the combination of features is not selected arbitrarily, but arrived at after prolonged research and development which addresses and balances issues of efficiency in manufacturing, durability, and comfort.

In conventional methodologies, in order to ensure the bristles be securely installed to a substrate layer, the substrate layer is made with relatively high rigidity. However, this would compromise the flexibility of the substrate layer and thus the extent or degree of cushioning. Another conventional methodology is to apply a thick layer of glue for securing end portions of the bristles. However, this methodology is costly to implement, and the efficiency is low.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

I claim:

1. A method of manufacture of a hair brush, comprising steps in the sequence of:

forming a base layer in the form of a mesh by way of a first molding step, the base layer defining an upper surface and a lower surface opposite to the upper surface, made of a first material selected from the group consisting of polypropylene (PP), nylon, polyoxymethylene (POM) and thermoplastic elastomer (TPE), and including a plurality of recesses with apertures at the upper surface;

forming a substrate layer for supporting bristles of the hair brush by a second molding step of overmoulding a finishing layer over the base layer, the finishing layer made of a second material; and installing the bristles to the substrate layer at the recesses through the apertures; and assembling the substrate layer installed with the bristles to a casing of the hair brush.

2. A method as claimed in claim 1, wherein the base layer has a Flexural Modulus from substantially 900-1300 MPa.

3. A method as claimed in claim 1, wherein the recesses resembling cups sized and shaped to receive end portion of the bristles shot or otherwise installed into the recesses.

4. A method as claimed in claim 1, wherein the second material is selected from the group consisting of silicone, rubber and thermoplastic elastomer (TPE).

5. A method as claimed in claim 1, wherein the finishing layer has a Flexural Modulus from substantially 51-69 MPa.

6. A method as claimed in claim 5, wherein the finishing layer has a Flexural Modulus of substantially 60 MPa.

7. A method as claimed in claim 1, wherein the substrate layer has a Flexural Modulus from substantially 68-92 MPa.

8. A method as claimed in claim 7, wherein the substrate layer has a Flexural Modulus of substantially 80 MPa.

9. A method as claimed in claim 1, wherein after the second moulding step at least part of the apertures remain open.

10. A method as claimed in claim 1, wherein after the second moulding step the lower surface is not overmoulded with the second material.

11. A method as claimed in claim 1, wherein the bristles are secured in the recesses of the base layer by using pins or staples.

12. A method as claimed in claim 1, being free of using glue in securing the bristles to the base layer.

13. A method of manufacture of a hair brush, comprising steps in the sequence of:

forming a base layer in the form of a mesh by way of a first molding step, the base layer defining an upper surface and a lower surface opposite the upper surface, and made of a first material with a Flexural Modulus from substantially 900-1300 MPa, and including a plurality of recesses with apertures at the upper surface;

forming a substrate layer for supporting bristles of the hair brush by a second molding step of overmoulding a finishing layer over the base layer, the finishing layer made of a second material; and installing the bristles to the substrate layer at the recesses through the apertures; and assembling the substrate layer installed with the bristles to a casing of the hair brush.

14. A cushion hair brush comprising;

a base layer in the form of a mesh formed by first injection molding step, said base layer defining an upper surface and a lower surface opposite the upper surface, made of a first material with a Flexural Modulus from substantially 900-1300 MPa, and including a plurality of recesses with apertures at the upper surface;

a substrate layer for supporting bristles of said hair brush, said substrate layer including a finishing layer overmoulded over said base layer, said finishing layer made of a second material with a Flexural Modulus from substantially 51-69 MPa; and bristles installed to said substrate layer at the recesses via the apertures; and a housing fitted with said bristle-installed substrate layer;

wherein said substrate layer, at default, assumes a dome shape defining an outwardly facing and concave surface, and is adapted to respond to pressure applied to the bristles during use by inwardly flexing towards the housing thus producing a cushioning effect.

15. A hair brush as claimed in claim 14, wherein the recesses are in the form of cups sized and shaped to receive end portion of said bristles shot or otherwise installed into the recesses.

16. A hair brush as claimed in claim 14, wherein the first material is selected from the group consisting of polypropylene (PP), nylon, polyoxymethylene (POM) and thermoplastic elastomer (TPE).

17. A hair brush as claimed in claim 14, wherein the second material is selected from the group consisting of silicone, rubber and thermoplastic elastomer (TPE).

18. A hair brush as claimed in claim 14, wherein said finishing layer has a Flexural Modulus from substantially 60 MPa.

19. A hair brush as claimed in claim 14, wherein said substrate layer has a Flexural Modulus from substantially 68-92 MPa.

20. A hair brush as claimed in claim 19, wherein the substrate layer has a Flexural Modulus of substantially 80 MPa.

21. A hair brush as claimed in claim 14, wherein at least part of the apertures of said base layer overmoulded with said finishing layer remains open.

22. A hair brush as claimed in claim 14, wherein the lower surface of said base layer is not overmoulded with the second material.

23. A hair brush as claimed in claim 14, comprising pins or staples for securing said bristles in the recesses of said base layer.

24. A hair brush as claimed in claim 14, being free of glue for securing said bristles to said base layer.

* * * * *